United States Patent [19]

Herst et al.

[11] Patent Number: 4,644,454

[45] Date of Patent: Feb. 17, 1987

[54] LENSED INDIRECT LUMINAIRE HAVING IMPROVED LIGHT DISTRIBUTION CONTROL

[75] Inventors: Douglas J. Herst, Ross; Peter Y. Y. Ngai, Danville, both of Calif.

[73] Assignee: Peerless Lighting Corporation, Berkeley, Calif.

[21] Appl. No.: 687,474

[22] Filed: Dec. 28, 1984

[51] Int. Cl.[4] ..... F21V 5/00

[52] U.S. Cl. ..... 362/224; 362/260; 362/330; 362/331; 362/339; 362/361

[58] Field of Search ..... 362/217, 223–225, 362/235, 236, 242, 244, 257, 260, 268, 290, 292, 311, 317, 326, 331, 332, 339, 340, 351, 355, 361, 362, 367

[56] References Cited

U.S. PATENT DOCUMENTS

| | | | |
|---|---|---|---|
| 2,050,429 | 8/1936 | Dorey et al. | 362/224 |
| 2,151,801 | 3/1939 | Rolph | 362/331 |
| 2,269,182 | 1/1942 | Claspy et al. | 362/361 |
| 2,662,165 | 12/1953 | Franck | 362/224 |
| 2,802,097 | 8/1957 | Franck | 362/331 |
| 3,163,365 | 12/1964 | Stevens | 362/330 |
| 3,701,896 | 10/1982 | Pate | 362/224 |
| 4,059,755 | 11/1977 | Brabson | 362/330 |
| 4,246,629 | 1/1981 | Marrero | 362/225 |
| 4,390,930 | 6/1983 | Herst et al. | 362/224 |

FOREIGN PATENT DOCUMENTS

| | | |
|---|---|---|
| 54-39980 | 3/1979 | Japan . |
| 54-39981 | 3/1979 | Japan . |

OTHER PUBLICATIONS

Holophane Brochure for Merculine 2000 Series No. 6-S 1972 (Jan.).

*Primary Examiner*—Craig R. Feinberg
*Attorney, Agent, or Firm*—Donald L. Beeson

[57] ABSTRACT

An elongated indirect luminaire is provided with two separate lens elements in the form of a primary trough-shaped lens cover supported over the luminaire's light source and at least one secondary lens strip supported laterally of the primary lens cover. A prismatic surface is formed on the lens cover for directing a portion of the available source light to the secondary lens strip; the secondary lens in turn has a prismatic surface designed for redirecting the light in a desired controlled fashion. The laterally placed secondary lens provides added control to the light distribution in the lateral regions of the luminaire near the luminaire's operative horizontal plane, and, in the illustrated embodiment, is designed to slightly boost the light in the lateral regions near the horizontal plane in a manner that provides improved control over the luminance of the secondary lens at viewing angles near the horizontal plane of the fixture. Such optical control provides a visible low brightness secondary lens in a fixture mounted at or near eye level.

9 Claims, 8 Drawing Figures

| | | |

| PRISM | DEG |
|---|---|
| 1 | 56 |
| 2 | 56 |
| 3 | 56 |
| 4 | 57 |
| 5 | 50 |
| 6 | 50 |
| 7 | 50 |
| 8 | 50 |
| 9 | 50 |
| 10 | 50 |
| 11 | 50 |
| 12 | 50 |
| 13 | 50 |
| 14 | 50 |
| 15 | 61 |
| 16 | 62 |
| 17 | 62 |
| 18 | 63 |
| 19 | 63 |
| 20 | 64 |
| 21 | 64 |
| 22 | 65 |
| 23 | 65 |
| 24 | 66 |
| 25 | 66 |
| 26 | 67 |
| 27 | 67 |
| 28 | 68 |
| 29 | 68 |
| 30 | 69 |
| 31 | 69 |
| 32 | 70 |
| 33 | 70 |

LUMINAIRE : HEAVY DUTY EXTRUSION, SYNTHETIC ENAMEL REFLECTOR, CLEAR PLASTIC ENCLOSURE WITH INTERNAL PRISMS, VERTICAL FRONT PRISMATIC PLASTIC PANEL.

LAMP: THREE F032T8, EACH RATED 2900 LUMENS.

BALLAST: UNIVERSAL CAT. NOS. 748—L—TO—P AND 749—L—TO—P

MOUNTING: WALL

LUMEN TO CANDELA RATIO USED = 9.15

TOTAL INPUT WATTS = 100.6 AT 120.0 VOLTS

THE 0 DEGREE PLANE IS PERPENDICULAR TO THE LAMPS.

CANDELA DISTRIBUTION

| | 0.0 | 45.0 | 90.0 | 135.0 | 180.0 | FLUX |
|---|---|---|---|---|---|---|
| 0 | 0 | 0 | 0 | 0 | 0 | |
| 5 | 1 | 1 | 1 | 1 | 1 | 0 |
| 15 | 6 | 3 | 1 | 1 | 1 | 1 |
| 25 | 11 | 6 | 0 | 0 | 0 | 2 |
| 35 | 20 | 11 | 0 | 0 | 10 | 4 |
| 45 | 29 | 17 | 1 | 7 | 33 | 11 |
| 55 | 42 | 27 | 1 | 22 | 56 | 22 |
| 65 | 58 | 36 | 0 | 44 | 92 | 38 |
| 75 | 77 | 39 | 0 | 73 | 127 | 56 |
| 85 | 104 | 40 | 0 | 106 | 155 | 75 |
| 90 | 116 | 48 | 1 | 134 | 171 | |
| 95 | 197 | 131 | 18 | 213 | 215 | 164 |
| 105 | 613 | 462 | 103 | 554 | 734 | 480 |
| 115 | 963 | 750 | 270 | 959 | 1198 | 765 |
| 125 | 1123 | 963 | 438 | 1120 | 1429 | 857 |
| 135 | 1261 | 1081 | 608 | 1191 | 1433 | 817 |
| 145 | 1235 | 1069 | 761 | 1188 | 1378 | 684 |
| 155 | 1174 | 1090 | 897 | 1200 | 1292 | 514 |
| 165 | 1155 | 1103 | 1005 | 1190 | 1238 | 319 |
| 175 | 1063 | 1057 | 1065 | 1105 | 1126 | 104 |
| 180 | 1072 | 1072 | 1072 | 1072 | 1072 | |

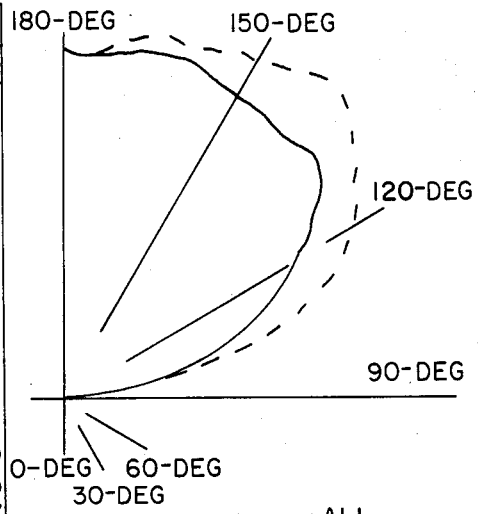

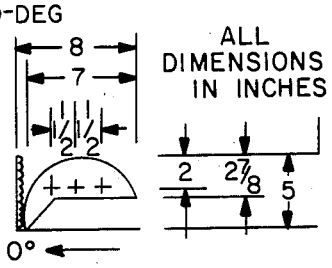

ZONAL LUMEN SUMMARY

| ZONE | LUMENS | %LAMP | % FIXT |
|---|---|---|---|
| 0-30 | 3 | .0 | .1 |
| 0-40 | 7 | .1 | .1 |
| 0-60 | 40 | .5 | .8 |
| 0-90 | 210 | 2.4 | 4.3 |
| 90-120 | 1408 | 16.2 | 28.7 |
| 90-130 | 2265 | 26.0 | 46.1 |
| 90-150 | 3766 | 43.3 | 76.7 |
| 90-180 | 4703 | 54.1 | 95.7 |
| 0-180 | 4912 | 56.5 | 100.0 |

LUMINANCE DATA IN FOOTLAMBERTS

| ANGLE IN DEG | AVERAGE 0-DEG | AVERAGE 45-DEG |
|---|---|---|
| 0 | 0 | 0 |
| 45 | 77 | 64 |
| 55 | 97 | 88 |
| 65 | 121 | 106 |
| 75 | 150 | 108 |
| 85 | 197 | 107 |
| 90 | 219 | 128 |
| 95 | 373 | 351 |

TOTAL LUMINARE EFFICENCY = 56.5%

TOTAL REFLECTANCE OF PAINT = 88.0%

DIE TYPE — INDIRECT

| PLANE | 0-DEG | 90-DEG |
|---|---|---|
| LUMENOUS LENGTH | 0.00" | 48.00" |
| HIGHT OF SIDE | 0.00" | 2.25" |

FIG.—7

LENSED INDIRECT LUMINAIRE HAVING IMPROVED LIGHT DISTRIBUTION CONTROL

BACKGROUND OF THE INVENTION

The present invention generally relates to indirect lighting fixtures of the type used in office, commercial and industrial environments, and more particularly it relates to lensed indirect lighting fixtures, that is, indirect lighting fixtures which achieve light distribution control, in part, by a prismatic lens or lenses located at the top opening of the fixture.

The advantages of indirect over direct lighting are well known and are discussed in U.S. Pat. No. 4,390,930 to Herst and Ngai, the applicants herein. This patent also discusses the incorporation of prismatic lenses into the optical design of indirect luminaires and, additionally, the psychological advantage of exposing at least a portion of the lens surface to the room so as to give people in an indirect lighting environment the sense of seeing an actual light source. The Herst patent discusses the offsetting problem that visible prismatic lenses, when illuminated, are normally uncomfortably bright to directly look at and proposes for desired aesthetic qualities and visual comfort an indirect luminaire having visible side lens strips, the surface brightness of which is carefully controlled to a low range of luminance. In terms of the luminaire's light distribution pattern, Herst shows that visual comfort can be achieved by a prismatic lens design (and lamp position) which intentionally directs a portion, but only a very small portion of light below the horizontal plane of the luminaire.

One problem with the lensed indirect luminaire disclosed in the U.S. Pat. No. 4,390,930 patent is that it tends however to be limited to mounting heights well above eye level, such as high wall mountings or ceiling suspended fixtures; this luminaire is not well suited for applications calling for low, near eye level mounting heights because at low mounting heights the lens, despite careful optical design, still becomes overly bright at high viewing angles from which the lens is normally seen. Exemplary of low mounting height uses are luminaires mounted to modular office furniture and, increasingly, fixtures mounted in proximity to word processing work stations. One type of fixture previously used in such applications is an indirect fixture having high opaque side walls and no refracting lens, the optical result being no significant lateral distribution of light. The advantage of such a totally indirect fixture design is that there are no overly bright lamp or lens surfaces to produce visual discomfort. The disadvantages, however, are that widespread distribution of the light is sacrificed and undersirable bright spots are produced on the overhead ceiling. Such fixtures also prevent persons from easily locating the fixture and realizing the resulting psychological advantages discussed above. Another indirect type of fixture designed for approximately eye level mounting heights is a fixture disclosed in applicant's co-pending application No. 046,970, wherein a lens cover is employed over the top opening of the fixture to spread the available source light laterally and more evenly. This fixture, however, does not control lens brightness and presents to an observer a visible lens that is uncomfortably bright.

The present invention overcomes the problem of providing low luminance in the visible lens surface of a lensed indirect luminaire mounted at low mounting heights. The invention increases light distribution control in vertical plane angles near the horizontal plane of the fixture, providing widespread light distribution from a lensed indirect luminaire having visible low brightness lens surfaces.

SUMMARY OF THE INVENTION

In the present invention an indirect luminaire having a light source and a housing is provided with both a primary lens means and a secondary lens means, the latter of which presents a visible lens surface at normal viewing angles. The primary lens means is mounted to the housing in spaced relation to the light source so as to receive and redirect at least a portion of the luminaire's source light, while the secondary lens means is mounted to the outside of the primary lens means to receive light from the primary lens means. Optically, at least a portion of the primary lens means is formed to bend source light in the direction of the secondary lens means and the secondary lens means is in turn formed to further bend and direct light from the primary lens means in a desired controlled fashion, such as hereinafter described. The primary lens means will thusly serve to focus at least a portion of the available light to the secondary lens, providing, with respect to the light passing through the secondary lens, a greater light collection angle and, as described below, a apossible greater degree of directionality control in the form of greater light ray parallelism.

In a preferred aspect of the invention, and in accordance with the embodiment described and illustrated herein, the luminaire is comprised of an elongated, linear housing and elongated, linear lens elements, all of which would typically be fabricated from extruded materials. The illustrated primary lens is in the form of a full lens cover supported above the light source and the illustrated secondary lens is in the form of a separate partial lens or lens strip laterally displaced from and parallel to the lens cover. The invention, however, is not limited to a full primary and partial secondary lens; either lens could be in the form of a full or partial lens so long as light control in the lateral regions of the fixture is achieved as described herein.

In regard to light control, the two lenses are described as being formed to redirect the luminaire's light output generally in the lateral regions of the luminaire's vertical plane in a widespread distribution while carefully controlling the luminance of the secondary lens strip at viewing angles near horizontal (90° vertical angle); it will be seen that under this optical embodiment the lateral portions of the primary lens cover serve to push or spread the light laterally of the luminaire, while the secondary lens will serve to "kick" the lateral light received from the primary lens slightly upwardly with the object of eliminating excessive brightness in the lens at low mounting heights where the viewing angle is very close to horizontal. It will be understood that the secondary lens might be designed to serve other optical functions as well. For example, a portion of the secondary lens means might be used to direct a small amount of light from the primary lens means downwardly toward the adjacent task area while at the same time improving the lateral directionality of the light. The dual optical result would be to provide some direct task area illumination using a portion of the total available light from an otherwise indirect fixture and a low brightness lens at eye level.

Therefore, it can be seen that the primary object of the invention is to provide an indirect luminaire that has lens controlled widespread optics and that provides a visually comfortable, low brightness, visible lens surface when the fixture is at low mounting heights. Such a fixture can be mounted on modular office systems and furniture to provide a comfortable lighting environment for office workers, and particularly for computer terminal operators where excessive brightness in front of or behind the operator can produce uncomfortable direct and reflected glare. Using the luminaire of the invention atop a six foot partition wall of a computer terminal work station, the lighting environment at the work station can particularly be enhanced, in that, the benefits of lighting the task area with indirect lighting can be realized while providing an aesthetically and psychologically pleasing illuminated lens element observable from and about the work station.

The invention in its preferred embodiment is described below in greater detail in reference to the following described drawings.

DESCRIPTION OF THE DRAWINGS

FIG. 7 graphically depicts a tested indirect light fixture using the lenses illustrated in FIGS. 5 and 6, and the resulting light distribution data therefrom set forth in tabular and graphical form.

DETAILED DESCRIPTION OF THE ILLUSTRATED EMBODIMENT

Figure 1:
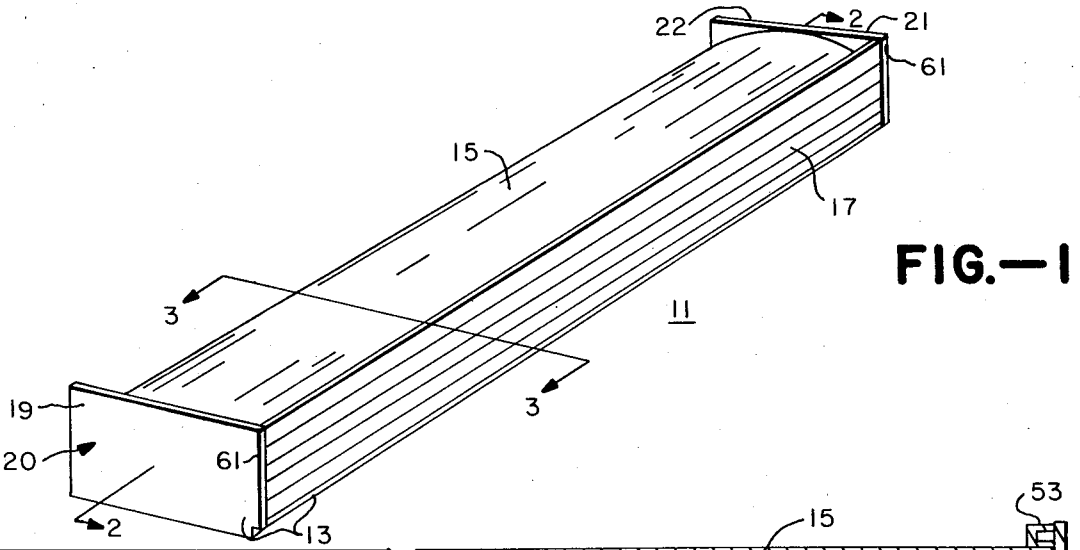
FIG. 1 is a perspective view of a lensed indirect luminaire made in accordance with the invention.

Referring now to the drawings, FIG. 1 illustrates a elongated, lensed indirect fixture, generally denoted by the numeral 11, that includes a elongated housing 13 and separate primary and secondary lens means in the form of, respectively, a linear, trough-shaped lens cover 15 and a straight lens strip 17 laterally spaced from the lens cover. The primary and secondary lens means the optical functions of which will be more fully described below, and which are preferably produced from plastic extrusions using, for example, extruded clear virgin acrylic, extend between the housing end plates 19, 21, and are supported by housing bottom wall 23. A readily understood variation of the described and illustrated elongated shape of the luminaire would be a circularly shaped luminaire having a central bowl shaped lens cover as a primary lens means and an outer concentric lens strip as a secondary means.

Figure 2:
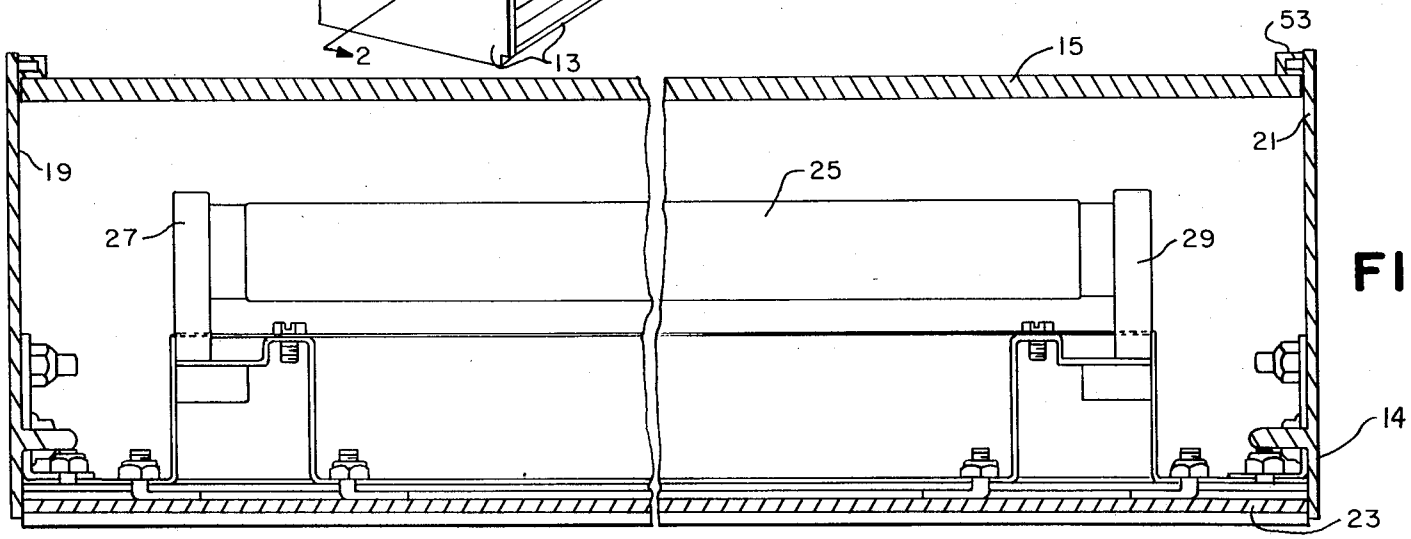
FIG. 2 is a cross-sectional view of the luminaire shown in FIG. 1 taken along lines 2—2.
Figure 3:
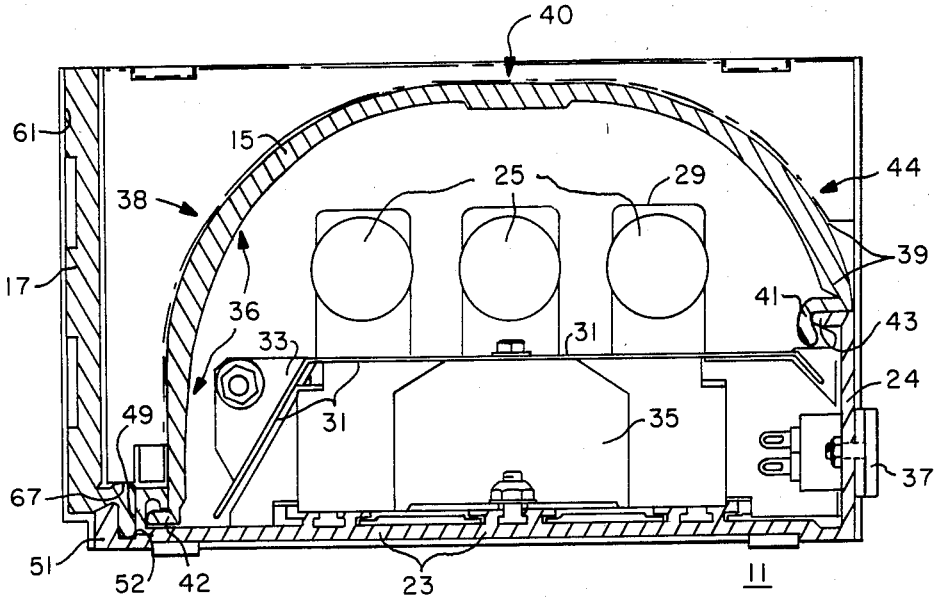
FIG. 3 is a cross-sectional view of the luminaire shown in FIG. 1 taken along lines 3—3.

With reference to FIGS. 2 and 3, it is seen that the luminaire light soure, which is covered by the primary lens cover, is comprised of three conventional side by side fluorescent lamps 25 secured between lamp sockets 27, 29. However, other lamp types and configurations could be used. For example, the luminaire might be designed as a two lamp or single lamp system for two side-by-side fluorescent lamps or only a single centrally mounted fluorescent lamp. Incandescent or HID lamps might also be used, however, the invention in the embodiment described herein is more readily adapted to a fluorescent lamp source.

With further reference to FIGS. 2 and 3, fluorescent lamps 25 are shown mounted over reflector 31. The reflector, which is secured to the housing by support brackets 33, will typically be fabricated of a highly reflective material, such as white enamel, specular aluminum, or aluminum with high and low index of refraction coatings, to maximize the available light from the fixture. The luminaire ballast is sandwiched between the reflector and housing bottom wall 23, and a suitable electrical inlet to which the ballast can be wired, such as receptacle 37, is provided in the housing back wall 24. Each of the electrified luminaires can be used alone or in series with other luminaires to provide an overall lighting system having the controlled low brightness lens optics described herein.

It is noted that the illustrated luminaire has only one secondary lens strip 17 and that, at the backside 44 of the luminaire, light passes through and is controlled by a single lens only. Such a lens configuration would be useful where only one side of the luminaire requires secondary lens optics as described herein and wherein the backside of the luminaire can have a less controlled widespread distribution of light, that is, where widespread light distribution is derived but where direct viewing of the lens is obscured by a partition, a wall or another fixture. It is understood, however, that the secondary lens 17 could be placed on both sides of the luminaire to provide the backside of the luminaire with secondary lens control optics as well.

As illustrated, the inverted trough-shaped lens cover 15 has a front side portion 38, top portion 40, and foreshortened back side portion 39. Along the lens' foreshortened backside portion there is formed an inwardly projecting, curved retaining rim 41 adapted to engage a corresponding inwardly projecting support ridge 43 formed at the top of the housing back wall 24 for securement of the back of the lens to the housing. The lens' front side portion 38 extends downwardly to meet the housing bottom wall 23 so as to provide, at the front side of the lens, a substantial curved prismatic lateral lens portion 36 which redirects the source light available at this primary lens surface to the secondary lens 17. The secondary lens strip is shown as extending substantially the height of the housing end plates 19, 21, and as having at its bottom edge 47 an inwardly projecting support ridge 49 which, when the lenses are assembled as hereinafter described, inserts over a retaining lip 51 into alignment channel 52 formed along the lateral edge of housing bottom wall 23.

Figure 4:
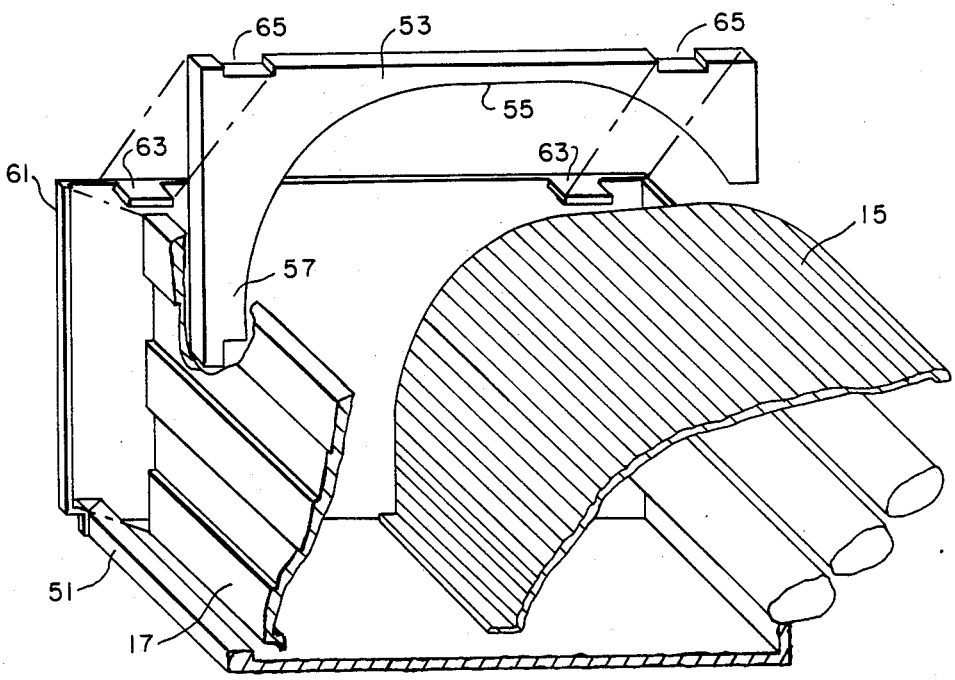
FIG. 4 is a partial cutaway view of the indirect luminaire of FIG. 1 illustrating the assembly of the fixture.

FIGS. 3 and 4 best illustrate the luminaire's two lens snap in assembly and how the lenses can readily be removed for replacement or cleaning. As shown, lens cover 15 and lens strip 17 are removably held in the fixture housing by means of removable end wall inserts 53 (one insert is provided at each end wall). Each insert has a suitably thick, arcuate bottom edge 55 that fits over and conforms to the ends of the primary lens cover. Each insert also has a downwardly projecting spacer leg 57 formed at its forward end that wedges between the lens cover and secondary lens strip to hold the secondary lens strip in place against the upwardly projecting bottom wall retaining lip 51 and the barrier strips 61 projecting inwardly along the front edges of end plates 19, 21. The removable end wall inserts are locked together with the end plates as integral end wall assemblies by means of end plate snap extensions 63 which snap over corresponding snap recesses 65 formed on top of the wall inserts. As can best be seen in FIG. 3, the secondary lens strip 17 is held down and cannot be removed with the retainer wall insertiOn place due to the engagement of the bottom surface 67 of the insert against the inwardly projecting support ridge 49 of the lens strip.

To install the primary and secondary lens on the fixture, an installer need only place the retaining rim 41 at the rearward end of the lens cover 15 against the mating support ridge 43 atop of the housing backwall 24 and then, by slightly compressing the plastic lens inwardly, snap the front retaining rim 42 of the lens cover in place underneath locking ridge 44 formed at the front of the housing bottom wall 23. The secondary lens strip is then inserted at the front of the housing downwardly against the two front barrier strips 61 until the lens strip's bottom support ridge 49 firmly seats over the housing wall's retaining lip 51. The two retainer wall inserts are then inserted as above-described to form the end wall assemblies which lock the lenses in place. Removal of the lenses can easily be accomplished by reversing this opeRation. This requires only a tool, such as a flat head screwdriver, capable of slightly bending snap extensions 63 upwardly to release the end wall inserts.

Figure 5:
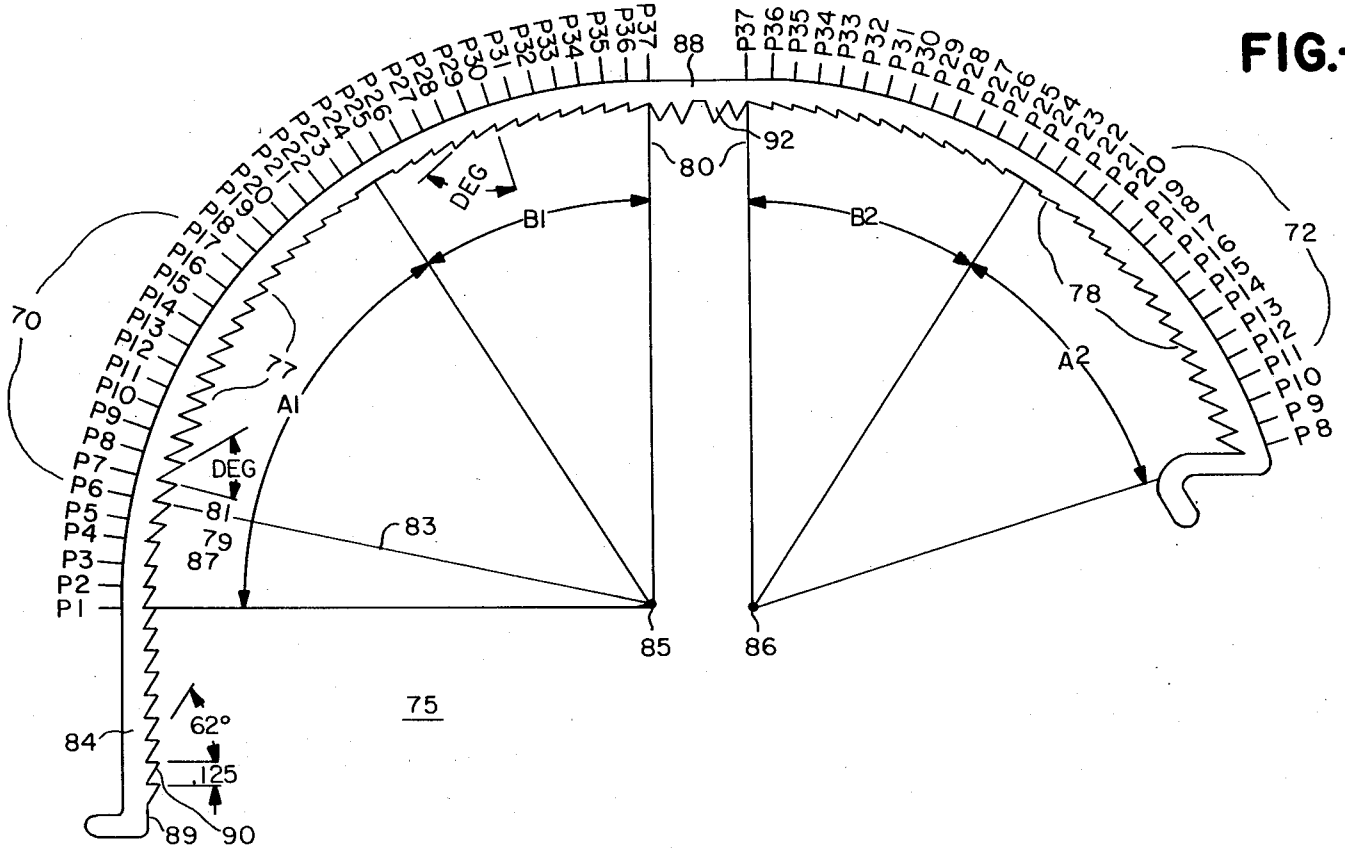
FIG. 5 is a side elevational view of a primary lens cover for achieving a widespread light distribution and directing light to the secondary lens.
Figure 6:
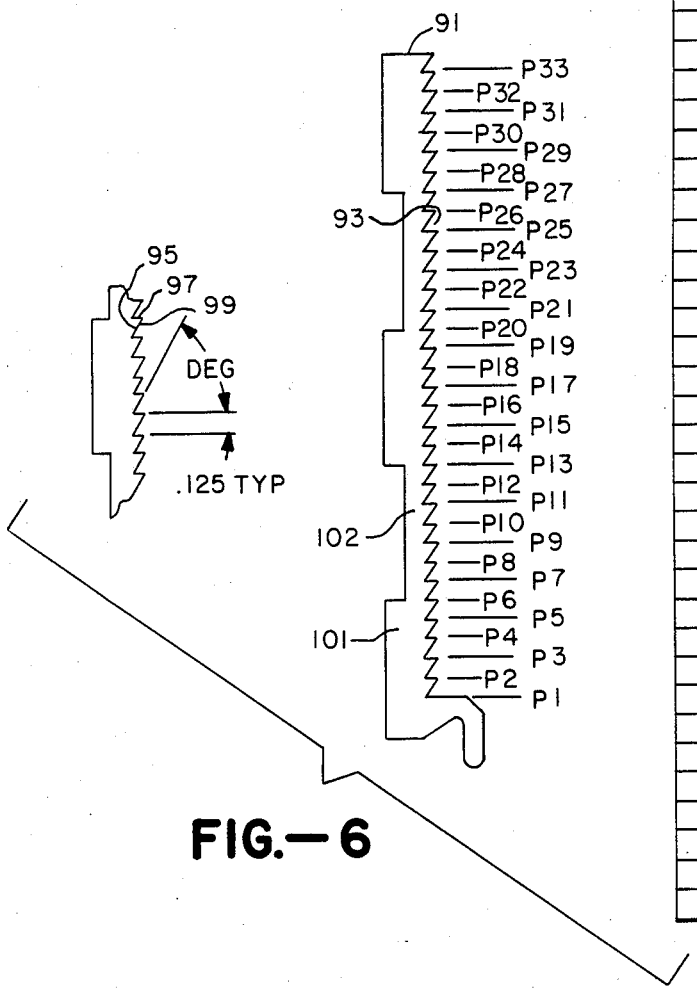
FIG. 6 is a side elevational view of a prismatic secondary lens used to redirect the laterally distributed light from the primary lens.
Figure 8:
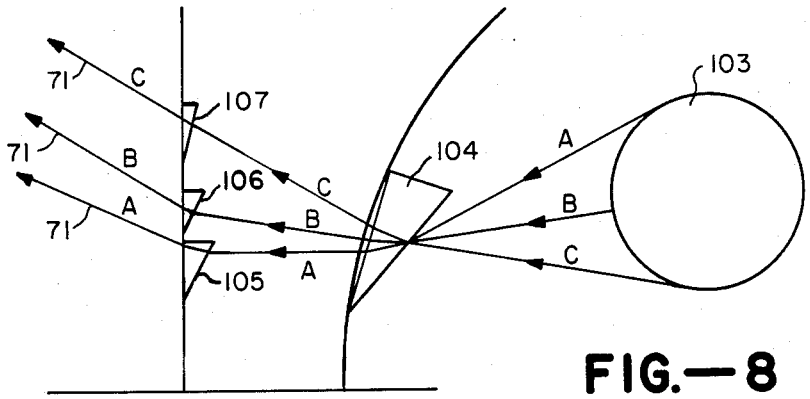
FIG. 8 is a pictorial representation of the luminaire light source, selected prisms of the primary and secondary lenses, and ray traces through the prisms from the light source.

Turning to the light bending properties of the lens cover 15 and side lens strip 17, reference is made to FIGS. 5 through 8 of the drawings, wherein FIG. 5 illustrates a prismatic surface configuration for the lens cover, FIG. 6 illustrates as prismatic surface configuration for the side lens, FIG. 7 depicts a light distribution pattern that can be achieved using the lens designs disclosed in FIGS. 5 and 6, and FIG. 8 graphically depicts, by means of a hypothetical ray trace analysis, the operation of the primary and secondary lenses 15, 17. The lens cover of FIG. 5, generally denoted by the numeral 73, has front side portion 70, forshortened backside portion 72, and interior prismatic lens surfaces made up of elongated, linear prisms that extend the length of the lens. The prismatic lens surfaces include a plurality of right angle prisms identified by prism numbers P1, P2, . . . P37 covering the front and back curved prismatic surfaces 77, 78 having, respectively, centers of curvature at centers denoted 35 and 36. The prismatic lens surfaces also include a group of top equilateral prisms 92 spanning the lens' flat top surface 88. It is seen that above prism P7, where its backside portion 72 is foreshortened, the lens cover is symmetrical about its vertical centerline 82. Below prism P8, however, the front side portion 70 of the cover lens extends downwardly to prism P1 along the radius of curvature centered at 85; from there the cover lens' front side portion 70 further extends in a straight extension 84 which has a continuing interior prismatic surface 90 composed of substantially identically sized right angle prisms.

Each right angle prism of the lens cover's interior prismatic surfaces 77 and 78 is defined by a riser surface and working surface. For example prism P10, also denoted by numeral 79, is defined by riser surface 81 falling on a radial line 83 from lens center 85, and working surface 87 facing downwardly toward the lens base 89. Such downwardly facing prisms (prisms P1–P23) are subtended by angle A1 at the front side of the lens and angle A2 at the back side of the lens, while reverse angle prisms, or prism having their working surface facing away from the lens base (prisms P24–P37) are shown as being subtended by angles B1 and B2. Each prism is further defined by a prism angle denoted "DEG" as illustrated in FIG. 5 for each of the "A" and "B" subtending angles. For a lens that generally achieves the objects of the invention, and particularly the light distribution pattern generally shown in FIG. 7, the prismatic angles for each of the numbered prisms of the lens cover for the indicated A and B subtending angles is shown in the table associated with the FIG. 5 lens cover. In the FIG. 5 illustration, a lens cover is shown having an overall front to back width of approximately 7 inches, a front and back radius of curvature of three inches, and a typical prism width, for all prisms including the top equiliteral prisms 92 and the straight extension prisms, of 0.125 inches.

Optically, the equilateral prisms 92 spanning the lens cover's flat top surface 88 act to spread or diffuse the upwardly directed to both sides of the fixture whereas the right angle prisms on the lens front and back side portions 70, 72 generally redirect the light in one direction only, i.e. laterally of the fixture, to a degree dictated by the angle of the incident light rays to the prisms working surface (see FIG. 8). The relative length of the lens cover's flat top surface 88 can be varied without materially changing the general light distribution pattern of the luminaire in the lateral directions. This would be accomplished by simply increasing or decreasing the number of equilateral prisms 92 on the flat top surface. Hence, the width of the trough shaped lens cover can be changed relative to the height to accomodate luminaires designed for different numbers of lamps, for example, conventional one, two or three lamp systems. Care must be taken, however, that the total candle power available from the lamps is not so great as to push the secondary lens brightness into acceptably high luminance ranges.

The secondary lens strip illustrated in FIG. 6, and generally denoted by the numeral 91, includes interior lens surface 93 composed of right angle prisms, which, referring to prism 95, can be defined by riser surface 97 and working surface 99. The prisms are further defined by prism angles denoted "DEG", which, for the individual numbered prisms indicated in FIG. 6, are chosen in accordance with the prism angle table associated with FIG. 6. For added aesthetic effect color stripes 102 can be added to this visible lens strip, and to the highlight the color stripes the stripes can be in relief on the lens wherein the clear lens areas 102 are of lesser thickness than the color striped areas 101.

The primary lens and secondary lens of FIGS. 5 and 6 generally act together as follows: The front lateral surface portion 70 of the primary lens (generally encompassing prisms P1–P37 and straight lens extension 84) bends the light passing through this portion generally laterally from the fixture, more in the region of the fixture's horizontal plane, denoted by the letter H in FIG. 2. The secondary lens 91, wherein the prism angles (riser surface to working surface angle) are seen to generally increase when moving up the prismatic surface 93, receives most of this laterally directed light and acts to "kick" or boost this light upwardly. The operation by the two lenses on light rays emanating in diverse directions from different points on the light source is illustrated in FIG. 8, wherein ray traces denoted A, B, C, emanate, respectively, from the top, middle and bottom of lamp 103 and pass through graphically depicted prism 104 on the primary lens cover, and from there through three different graphically depicted prisms 105, 106, 107 of the secondary lens strip. This graphical depiction shows that ray trace A is bent to a greater degree by the secondary lens prism 105 than is ray trace C, which is received by secondary lens prism 107 having a larger prism angle relative to the pendicular riser surfaces. By being "kicked" up, the exiting rays 71 generally exhibit greater parallelism or focus. This is achieved, however, with some sacrifice of the amount of light in the vertical angles close to the horizontal plane of the fixture.

Turning to the light distribution data and graph of FIG. 7, the distribution of light in candelas (a measure of luminous intensity) for different horizontal plane angles, 0°, 45°, 90°, 135°, 180°, is tabulated for vertical plane angles ranging in 5° increments from 0° to 180°. It is noted that the vertical plane angle of 90° represents the horizontal plane of the fixture. For low fixture mounting heights, the normally placed standing observer will see the secondary lens strip at very high viewing angles, that is, at viewing angles near and possibly slightly above the luminaire's horizontal plane (between roughly 75° and 95°). A seated observer might typically view the luminaire from about 45°. Consequently it is within these ranges of viewing angles that the illuminance (brightness) of the secondary lens is the most important.

In the FIG. 7 tabulation of data, there is also shown a table of data, entitled Zonal Lumen Summary, which indicates the percentage of the total light available from the fixture emitted in defined vertical angles of the vertical plane. From this table it can be seen that 76.7% of the total light from the fixture is directed in the vertical angles between 90° and 150°. This means that using the FIGS. 5 and 6 lenses, there would be a very large percentage of the light spread laterally of the fixture, which is advantageous in providing uniform illumination to the overhead ceiling surfaces and increasing the luminaire efficiency in spreading available light into adjacent regions of a room. At the same time, it is seen from the the third table entitled "Luminance Data In Footlamberts" where the brightness of the lens is calculated and tabulated for vertical viewing angles between and including 45° and 95°, for horizontal plane angles of 0° and 45°, that the brightness of the lens at normal high viewing angles is relatively low, and within the teachings of U.S. Pat. No. 4,390,930. In particular, it is seen that for the zero horizontal angle (looking perpendicularly straight on at the luminaire's side lens 17) the luminance of the secondary lens strip ranges from 77 footlamberts at the 45° degree vertical angle to 373 footlamberts at the 95° vertical angle. Above 95° the luminance will increase significantly, however, it is understood that controlled luminance in the secondary lens is primarily intended near and below the horizontal plane, i.e., in the directions from which the secondary lens will normally be viewed when the luminaire is mounted near eye level. To achieve the psychological benefits of a low brightness secondary lens a maximum average luminance range of between approximately 200 and 400 footlamberts is recommended for vertical angles below approximately 95°, through a luminance range of 100 to 500 footlamberts would generally be permissible in achieving the stated advantages.

Therefore, it can be seen that the present invention provides an indirect luminaire having primary and secondary lenses for achieving increased control over the distribution of light from the fixture. The invention particularly achieves control over the fixture's lateral light distribution, that is, over its light distribution characteristics in regions near the horizontal plane of the fixture, with the particular advantage of being able to provide a fixture at a low mounting height with a visually comfortable illuminated, low brightness lens. The indirect luminaire of the invention provides at the same time a widespread distribution of light wherein a substantial percentage of the total available light is pushed into vertical plane angles below approximately 150°.

While the preferred embodiment of the invention illustrated in the accompanying drawings has been described in considerable detail in the foregoing specification, it will be understood that the invention is not intended to be limited to such detail or to such drawings, except as is necessitated by the appended claims.

What we claim is:

1. A lensed indirect luminaire having improved light distribution control comprising a light source, a housing for supporting said light source, said housing extending in a horizontal plane of the luminaire and being open generally upwardly and laterally of the luminaire to allow light from said light source to be directed generally upwardly from said luminaire and laterally near and above the horizontal plane of the luminaire, a light transmitting primary lens means having along at least one of its sides a prismatic lens portion, said primary lens means being supported by said housing in spaced relation to said light source so as to receive at least a portion of said laterally directed light, and an elongated light transmitting secondary lens means positioned substantially normal to said plane, and having a prismatic lens portion, said secondary lens means being supported by said housing outwardly of and in lateral spaced relation to said primary lens means on the side of said prismatic lens portion of said primary lens, the linear prismatic surface portion of said primary lens means being formed to transmit therethrough and redirect substantially all light received from said light source in a direction towards said secondary lens means and the linear prismatic surface portion of said secondary lens means being formed to transmit therethrough and further redirect substantially all light from said primary lens means and whereby said first and second lens means effect directing the source light transmitted therethrough generally laterally of said luminaire to increasingly focus the source light as it passes through each of said lens means for controlling source light directionality near the plane of the housing.

2. The indirect luminaire of claim 1 wherein said housing includes an opaque bottom wall, and said primary lens means is in a form of a lens cover supported above said opaque bottom wall so as to at least partially cover said light source.

3. A lensed indirect luminaire having improved light distribution control comprising a light source, a linear, elongated housing for supporting said light source, said housing having an opaque bottom wall extending in a horizontal plane of the luminaire and being generally open upwardly and laterally of the luminaire to allow light from said light source to be directed generally upwardly from said luminaire and laterally near and above the horizontal plane of the luminaire, a light transmitting elongated primary lens cover supported above the opaque wall of said housing so as to at least partially cover said light source, said primary lens means having along at least one of its sides a linear lateral prismatic lens portion for receiving generally laterally directed light from said light source, and a light transmitting outer, linear secondary lens strip supported by and positioned substantially normal to said housing bottom wall laterally of and in spaced relation to said lens cover on the side of said linear prismatic lens portion of side primary lens, the lateral prismatic portion of said lens cover being formed to transmit and redirect substantially all light received from said light source in the direction of said secondary lens strip and said secondary lens strip being formed to transmit and further redirect light from the lateral prismatic portions of said lens cover and whereby said first and second lens means effect directing the source light transmitted therethrough generally laterally of said luminaire to increasingly focus the source light as it passes through each of said lens cover and lens strip for controlling source light directionality near the horizontal plane of the housing.

4. The indirect luminaire of claim 3 wherein said secondary lens strip is, substantially throughout its length, mounted in a uniform spaced relation to said primary lens.

5. The indirect luminaire of claim 4 wherein said secondary lens strip extends substantially upwardly from the opaque bottom wall of said housing to approximately a height same as that of said lens cover.

6. The indirect luminaire of claim 5 wherein said primary lens cover has a widespread distribution pattern and said secondary lens strip has a prismatic light bending surface formed to bend, on a more upwardly path, light rays received from substantially all points of said primary lens cover whereby the secondary lens strip acts to boost upwardly the widespread light distribution pattern of said primary lens cover in lateral regions of said light distribution pattern.

7. A lensed indirect luminaire having improved light distribution control in operative regions near a horizontal plane of the luminaire comprising an elongated light source including at least one fluorescent lamp, an elongated linear housing having an opaque bottom wall and being generally open upwardly and laterally of the luminaire to allow light from said light source to be directed generally upwardly from said luminaire and laterally near and above the horizontal plane of the luminaire, a primary lens means in a form of an elongated troughshaped lens cover removably supported by the opaque bottom wall of said housing so as to cover said light source, said lens cover having a linear lateral prismatic lens portion extending upwardly from at least one side of said lens cover for receiving generally laterally directed light from said light source, and at least one outer linear, elongated secondary lens strip removably supported by and positioned substantially normal to said housing bottom wall laterally of and along its length in uniform spaced relation to said primary lens means on the side of said linear prismatic lens portion of said primary lens, the lateral prismatic portion of said primary lens cover being formed to transmit and redirect substantially all light received from said light source in an upward widespread distribution pattern and said secondary lens strip being formed to transmit and redirect, on a more upwardly path, substantially all light rays received from said lens cover whereby the secondary lens strip acts to boost upwardly the upwardly widespread light disbribution pattern of said primary lens means in lateral regions of said distribution pattern.

8. The indirect luminaire of claim 7 wherein a secondary lens strip is removably mounted to only a front side of said luminaire and wherein the lens cover is foreshortened toward a back side of said luminaire and is supported on said back side by an opaque rear wall of said housing.

9. The indirect luminaire of claim 7 wherein said cover lens includes a top prismatic portion formed to spread upwardly directed light passing therethrough.

* * * * *